US006364142B1

(12) United States Patent
Kaspar

(10) Patent No.: US 6,364,142 B1
(45) Date of Patent: Apr. 2, 2002

(54) HYDRAULIC OIL FEED PLUNGER CYLINDER

(75) Inventor: Ernst Kaspar, Danziger Strasse 29, D-89597 Munderkingen (DE)

(73) Assignees: Compact Truck AG, Zug; Franz Lutz, Ehingen; Ernst Kaspar, Munderkingen, all of (DE)

( * ) Notice: Subject to any disclaimer, the term of this patent is extended or adjusted under 35 U.S.C. 154(b) by 0 days.

(21) Appl. No.: 09/529,302

(22) PCT Filed: Oct. 15, 1998

(86) PCT No.: PCT/EP98/06551

§ 371 Date: Jun. 23, 2000

§ 102(e) Date: Jun. 23, 2000

(87) PCT Pub. No.: WO99/20559

PCT Pub. Date: Apr. 29, 1999

(30) Foreign Application Priority Data

Oct. 17, 1997 (DE) ..... 297 18 478 U

(51) Int. Cl.[7] ..... B66C 23/70

(52) U.S. Cl. ..... 212/231; 212/238; 212/261; 212/349

(58) Field of Search ..... 212/349, 296, 212/299, 300, 230, 231, 238, 261; 182/2.9, 2.11

(56) References Cited

U.S. PATENT DOCUMENTS

| | | | | | |
|---|---|---|---|---|---|
| 3,657,969 | A | * | 4/1972 | Wirkus | 212/349 |
| 4,090,625 | A | * | 5/1978 | Walters | 212/349 |
| 4,775,029 | A | * | 10/1988 | MacDonald et al. | 182/2 |
| 4,867,321 | A | * | 9/1989 | Montgon | 212/196 |
| 5,249,643 | A | * | 10/1993 | Backer et al. | 182/2 |
| 5,769,251 | A | * | 6/1998 | Wada et al. | 212/231 |

FOREIGN PATENT DOCUMENTS

| | | | | |
|---|---|---|---|---|
| GB | 2068330 | * | 8/1981 | 212/296 |

* cited by examiner

*Primary Examiner*—Thomas J. Brahan
(74) *Attorney, Agent, or Firm*—Rothwell, Figg, Ernst & Manbeck

(57) ABSTRACT

A crane vehicle comprising a telescopic main boom which can be hydraulically configured by means of an assembly comprising a plunger cylinder and to which a derrick mast can be secured is provided with a plunger cylinder configured as a supply and discharge line for hydraulic fluid so that it can be used for conveying hydraulic fluid into a telescopic derrick mast which is mounted on the telescopic boom. Furthermore, a derrick cylinder which can be secured to the main boom is provided for hydraulically adjusting the inclination of the telescopic derrick mast.

16 Claims, 2 Drawing Sheets

HYDRAULIC OIL FEED PLUNGER CYLINDER

BACKGROUND OF THE INVENTION

1. Field of the Invention

The present invention relates to a crane vehicle comprising a telescopic boom which is hydraulically extensible by means of an assembly comprising a plunger cylinder. The boom can be extended by a derrick mast for enlarging the operating area of the crane.

2. Description of the Related Art

There is known a crane-vehicle which is provided with a telescopic boom that can be hydraulically extended by means of a plunger-cylinder assembly. Furthermore, it is known that the boom of the crane vehicle can be extended by means of a derrick mast for increasing the operative height of the crane. Different derrick masts are available for such a purpose. Derrick masts with large dimensions are produced as grid constructions which are anchored during operation. So far vehicle cranes with telescopic derrick masts have not been built.

As far as derrick masts are used on crane booms in the prior art, these are adjusted relative to the main boom with the help of ropes guided over at least one anchoring block. Said anchoring blocks form the point of action for the force that is e.g. required for lifting the derrick mast.

So far the experts have thought it technically impossible to provide a telescopic derrick mast in a vehicle crane. The reason for this assumption has to be seen in the fact that large amounts of hydraulic fluid have to be pumped upwards into the area of the derrick mast for telescopically extending a telescopic derrick mast on the one hand and for adjusting the inclination of a derrick mast on the other hand. To convey such large amounts of hydraulic fluid, flexible hoses for fluid media, which are known per se, must be provided with particularly large diameters. However, on account of the limited space on a crane vehicle, such large-dimensioned and long hoses for hydraulic media cannot be accommodated there.

A necessarily large hose diameter means that the hose in the wound state occupies a lot of space. However, since the storage space that is available on the crane vehicle for hoses is very limited, a further increase in the hose diameter is thus not possible. Furthermore, the small space that is available for wound hoses limits the hose length required for the extended crane system. Correspondingly large hose drums cannot be carried along on the crane vehicle, and a separate transportation by means of a trailer is excluded for economic reasons. A small hose diameter only allows the flow of small amounts of hydraulic fluid into the derrick mast, which makes it impossible to construct a hydraulically telescopic derrick mast of a satisfactory performance whose inclination is hydraulically adjustable. Furthermore, a hose system for the supply of hydraulic fluid to the derrick mast only allows for a limited length of the main boom because of the restricted hose length.

It is true that the drawback of the hose system, i.e. the derrick mast cannot be dimensioned in any desired way, can be avoided by using grid constructions as derrick masts. In such an instance, however, it must be accepted that grid constructions are not flexible and that their length is substantially unvariable after they have been mounted on the main boom. Furthermore, conventional derrick masts necessitate troublesome anchoring measures.

SUMMARY OF THE INVENTION

It is therefore the object of the present invention to provide a crane vehicle comprising a telescopic derrick mast of a hydraulically adjustable inclination and, in particular, to provide a supply line for hydraulic fluid which is capable of conveying the necessary large amounts of hydraulic fluid that are required for operating a derrick mast with large dimensions and a high load-bearing capacity.

This object is achieved in the case of a crane vehicle with a telescopic main boom [by the features indicated in the characterizing part of claim 1] in which a derrick mast can be telescoped hydraulically and a telescopic plunger cylinder of the main boom (20) is configured as a supply/discharge line for hydraulic fluid, the hydraulic fluid being adapted to be optionally supplied to a means for the telescopic extension of the derrick mast or to a derrick cylinder for hydraulically adjusting the inclination of the derrick mast.

The progress which can be achieved with the help of the invention is primarily due to the fact that neither an anchoring block nor a hydraulic fluid hose is needed for moving the derrick mast, i.e. for its telescopic movement and for the adjustment of its inclination. This advantage is due to the fact that thanks to the invention the large amounts of hydraulic fluid that are required for moving a telescopic derrick mast can be provided and pumped upwards to the derrick mast. Furthermore, the invention offers the advantage that the plunger cylinder of the main boom which is used as a supply line and discharge line, respectively, has an adequately large cross-sectional area through which large amounts of hydraulic fluid can flow. Moreover, the plunger cylinder is slid into itself while the boom is being retracted, so that in contrast to conventional hose supply systems an additional storage space is not needed. With respect to an advantageous space exploitation, the system of the invention is also superior to the conventional hose systems because of the combination of two functions in one component, as the plunger cylinder is firstly used for extending the boom and secondly as a supply line to the telescopic derrick mast. Thus an additional component, in this instance the hoses, can be dispensed with. In comparison with the conventional derrick masts designed as grid constructions, the hydraulically telescopic derrick mast of the invention can be handled more flexibly.

According to a preferred embodiment the derrick mast and also the derrick cylinder are detachably secured to the main boom.

Furthermore, according to a preferred embodiment of the present invention, it is possible that a telescopic inner tube is arranged within the plunger cylinder of the main boom. It is possible with the help of such an assembly to provide a hydraulic fluid circuit, for instance for a pump, in a compact form.

According to a further preferred embodiment of the present invention, lines which connect the plunger cylinder and the inner tube via a valve to a tank and a pump can be provided at the bottom end of the plunger cylinder. Advantageously, the arrangement of the tank and the pump at the bottom end of the plunger cylinder permits the combined use of the plunger cylinder as a device for extending the boom on the one hand and as a feed line to the derrick mast on the other hand.

According to another preferred embodiment of the present invention, lines can be provided at the upper end of the plunger cylinder for optionally connecting the plunger cylinder via valves either to the derrick mast or to the derrick cylinder. According to a further preferred embodiment of the present invention, the inner tube may serve as a pump return flow means and the space between inner tube and wall of the plunger cylinder as an advance flow means during extension while the derrick mast is operative.

Furthermore, according to a preferred embodiment the present invention, the inner tube may serve as a pump advance flow means during retraction of the derrick mast, and the space between inner tube and wall of the plunger cylinder as a pump return flow means.

Finally, according to a preferred embodiment of the present invention, the hydraulic medium may be a hydraulic oil.

BRIEF DESCRIPTION OF THE DRAWINGS

The present invention shall now be explained in more detail with reference to an embodiment taken in conjunction with the drawing, in which.

DETAILED DESCRIPTION OF THE PREFERRED EMBODIMENTS

Figure 1:
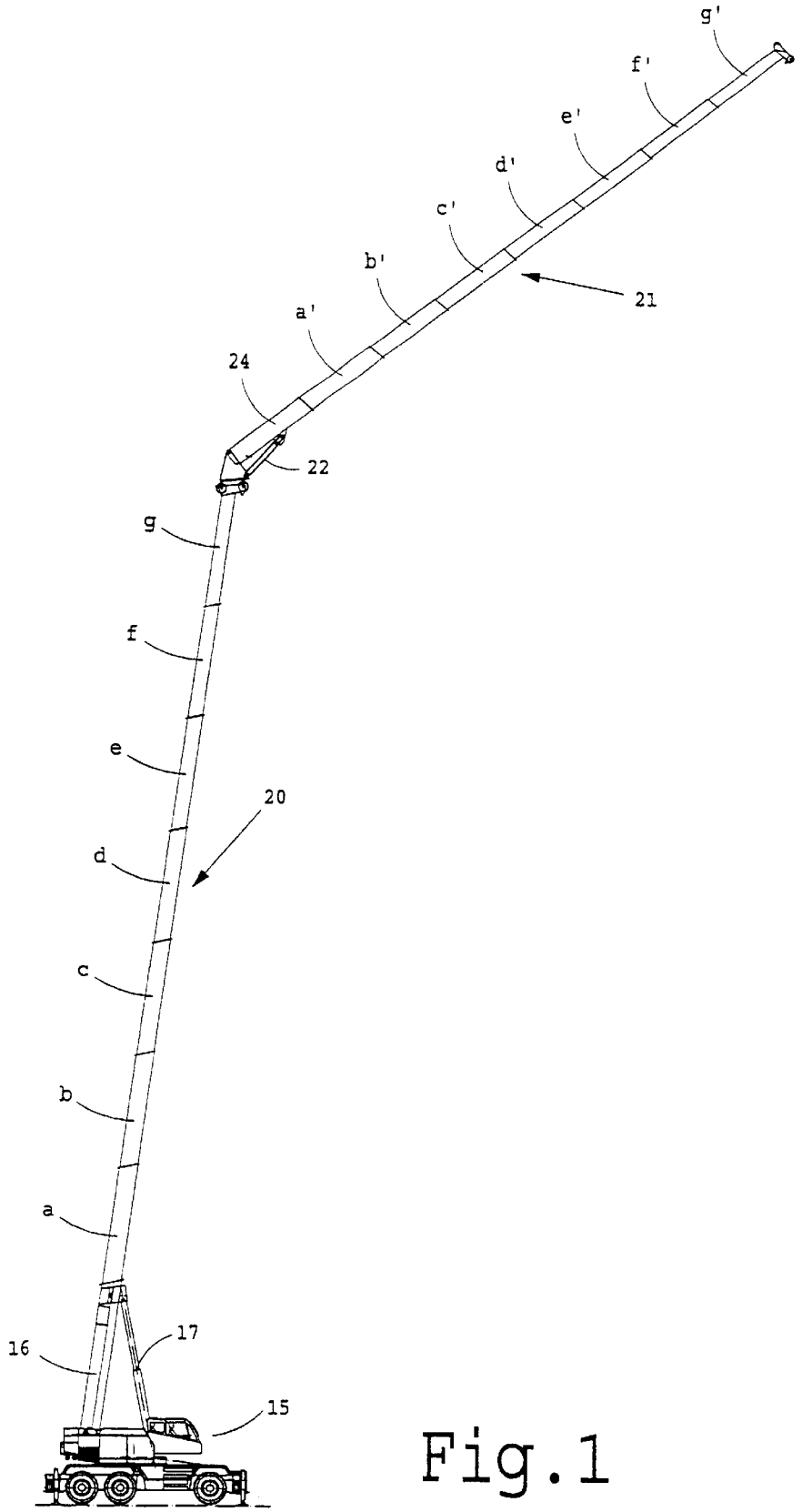
FIG. 1 is an overall view showing a crane vehicle with an extended boom and an extended derrick mast.

FIG. 1 shows a crane vehicle 15 in the operative position. The vehicle is supported on the ground via lateral supports, and the telescopic main boom 20 and the equally telescopic derrick mast 21 are extended into an operative position. The telescopic main boom 20 is provided in a per se known manner with a coupling member 16 pivotably connected to the crane vehicle 15, and with a plurality of telescopic sections a to g, which shall be designated in the following as telemembers. Said telemembers are slidable relative to one another during retraction and extension in a manner which is known per se, and all of the telemembers a to g are accommodated in the coupling member 16 in the driving position. A derrick cylinder 17 which is provided at the vehicle side serves to pivot the coupling member 16 in a manner which is known per se. Seven telemembers are provided in the illustrated embodiment. It goes without saying that a greater or smaller number of telemembers can also be used. The derrick mast 21 also consists of a plurality of telemembers a' to g' which can be telescoped from a base body 24 of the derrick mast. In the inoperative position all of the telemembers a' to g' of the derrick mast are accommodated in the base body 24 of the derrick mast. In the illustrated embodiment, seven telemembers a' to g' of the derrick mast are provided for. Of course, it is possible to use more or less than seven telemembers of the derrick mast. The length of the boom 20 ranges from 50 to 60 m; that of the derrick mast 21 from 30 to 50 m. These data are only meant to illustrate the dimensions of the main boom 20 and of the derrick mast 21 in an exemplary manner; smaller or greater longitudinal values are possible. The connection between the derrick mast 21 and the boom 20 can be disengaged so that the derrick mast can be separated from the boom for transportation. A telescopic plunger cylinder, which cannot be seen in FIG. 1, is arranged in the main boom 20 for hydraulically telescoping the boom. A hydraulic telescoping device, which e.g. may again comprise a plunger cylinder, is also arranged in the interior of the derrick mast.

A derrick cylinder 22 of large dimensions whose outer end is connected to the base body 24 of the derrick mast 21 is detachably mounted on the main boom, namely preferably on the last telemember g of the boom. The inclination of the derrick mast 21 can be hydraulically adjusted with the aid of said derrick cylinder 22. Thus, said (second) derrick cylinder 22 assumes the function of conventional derrick cylinder type anchoring blocks. As shall still be described in more detail further below, hydraulic oil can be supplied to the derrick cylinder 22 through the plunger-cylinder assembly contained in the main boom 20 because said plunger-cylinder assembly is configured as a supply and discharge line for hydraulic fluid for telescopically extending the derrick mast 21 and for adjusting the inclination thereof.

Figure 2:
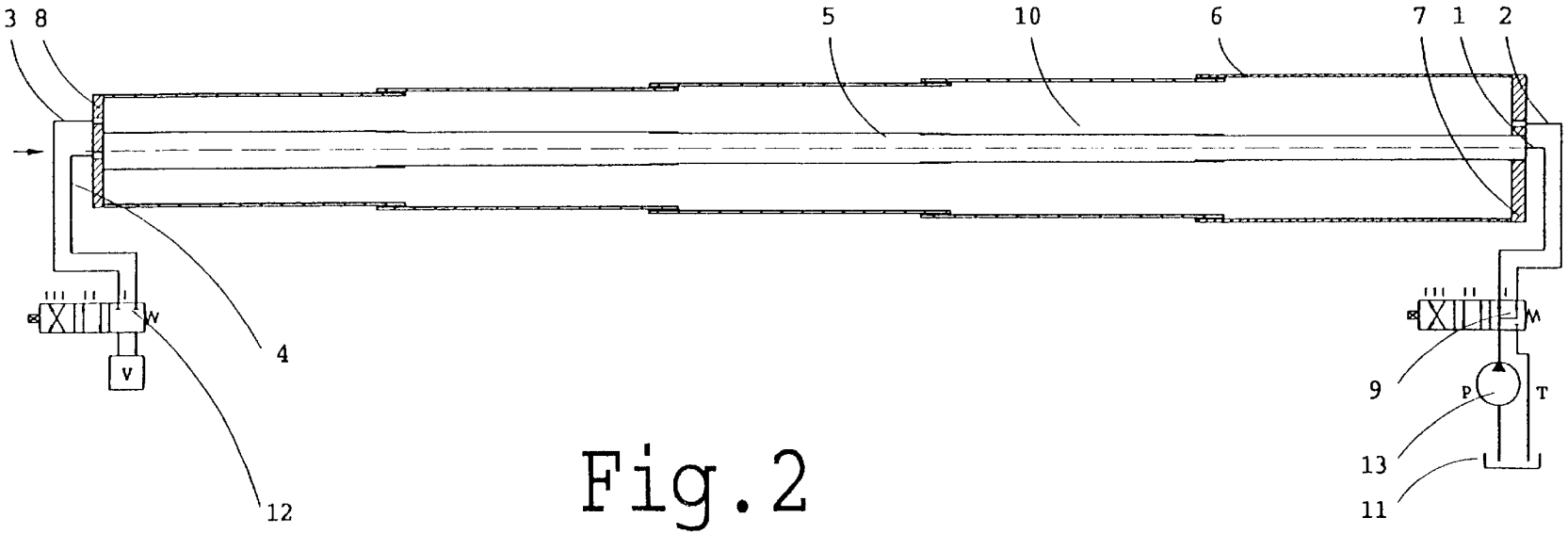
FIG. 2 is a cross-sectional view through the telescopic plunger cylinder located inside the boom with a telescopic inner tube and valve-controlled supply and discharge lines.

FIG. 2 shows a plunger cylinder 6 which is provided in the main boom 20 and is in the extended state, and in the interior of which the inner tube 6 is configured to be telescopic. The plunger cylinder 6 is terminated by a bottom part 7 and a head part 8. A cavity 10 is formed between the outer wall of the inner tube 5 and the inner wall of the plunger cylinder 6. Said cavity 10 is connected at the bottom side via a line 2 and a valve 9 to a pump 13 and a tank 11 for hydraulic oil. At the consumer side, i.e. at the side on which the derrick mast 21 is mounted, the cavity 10 is connected via a line 3 and a multi-way valve 12 to the derrick mast 21. The inner tube 5 is connected via a line 1 and via valve 9 to the pump 13 in tank 11. At the other side, the inner tube 5 is connected via a line 4 and the multi-way valve 12 to the derrick mast 21 and the derrick cylinder 22, respectively. The plunger cylinder 6 with the inner tube 5 is formed in the interior of the boom 20 (FIG. 1). Reference numeral V in FIG. 2 jointly designates the hydraulic oil consumers, i.e. the derrick mast 21 and the derrick cylinder 22.

When, e.g. during drive operation, the telescoped plunger cylinder 6 is extended into the position shown in FIG. 2, valves 9 and 19 are in position 1. Valve 9 is here opened and valve 12 closed so that hydraulic fluid can flow via lines 1 and 2 into both the plunger cylinder 6 and the inner tube 5. The pressure prevailing in the plunger cylinder is thereby increased, and the individual elements of the plunger cylinder 6 slide apart in telescopic fashion. Since hydraulic fluid is pumped from tank 11 into both the plunger cylinder 6 and the inner tube 5, this has the effect that the pressure surface on the bottom part 7 and on the head part 8 is increased, whereby the plunger cylinder 6 is slid out more efficiently. When the plunger cylinder 6 and thus the main boom 20 have been extended entirely, as shown in FIGS. 1 and 2, the individual telemembers a to g and also the telemember a are locked to the coupling member 16 of the main boom 20. As a result, the boom 20 is no longer held by the pressure of the fluid column, but by the mechanical connection of the individual telemembers among one another. This has the effect that the hydraulic fluid is now available for the telescopic extension of the derrick mast 21 and for supply into the derrick cylinder 22.

The derrick mast 21 is extended in the respective valve positions 11 of valves 9 and 12 and its angular position is varied. In valve position 11 the derrick mast 21 is connected to a pump circuit. The advance flow of the hydraulic fluid takes place through the cavity 10 of the plunger cylinder 6 and the return flow of the hydraulic fluid through the inner tube 5. Thanks to the large cross-section of the plunger cylinder 6, the large amounts of hydraulic fluid that are required for the telescopic extension and inclination adjustment of the derrick mast 21 can be pumped into the derrick mast and the derrick cylinder 22, respectively.

Whenever the derrick mast 21 is to be retracted, each of valves 9 and 12 is moved into its valve position III, so that the advance flow now takes place via the inner tube 5 and the return flow via the cavity. As a result, the pressure keeping the derrick mast 21 in the extended state is reduced, whereby the derrick mast is retracted and excessive hydraulic fluid flows back into tank 11.

FIG. 1 shows an embodiment of a crane system with large dimensions of the boom and derrick mast. The invention is particularly suited for operating crane systems of such dimensions, but can of course also be used for systems having smaller dimensions. Apart from the use of hydraulic oil as the hydraulic fluid, other media could also be employed. Valves 9 and 12, in particular valve positions I, II, III, are only shown schematically and are mainly intended to illustrate the flow directions of the hydraulic fluid during use of the derrick mast 21.

What is claimed is:

1. A crane vehicle comprising:

a telescopic main boom (20) which is hydraulically extensible;

a telescopic plunger cylinder;

a derrick mast secured to said telescopic main boom;

wherein the derrick mast (21) can be telescoped hydraulically; and wherein the telescopic plunger cylinder (6) of the telescopic main boom (20) is configured as a supply/discharge line for hydraulic fluid, said hydraulic fluid being adapted to be supplied to a means for the telescopic extension of the derrick mast (21) for hydraulically adjusting an inclination of the derrick mast.

2. The crane vehicle according to claim 1, characterized in that the derrick mast (21) is detachably secured to the telescopic main boom (20).

3. The crane vehicle according to claim 1, characterized in that a telescopic inner tube (5) is arranged within the plunger cylinder (6).

4. The crane vehicle according to claim 1, characterized in that lines (3, 4) are provided at an upper end of the plunger cylinder (6) for hydraulically connecting the plunger cylinder (6) via a multi-way valve (12) to a derrick cylinder (22).

5. The crane vehicle according to claim 1, characterized in that lines (3, 4) are provided at an upper end of the plunger cylinder (6) for hydraulically connecting the plunger cylinder (6) via a multi-way valve (12) to the derrick mast (21).

6. The crane vehicle according to claim 5, characterized in that during extension and during operation of the derrick mast (21) an inner tube (5) serves as a pump return flow means and a space (10) between the inner tube (5) and a wall of the plunger cylinder (5) serves as a pump advance flow means.

7. The crane vehicle according to claim 5, characterized in that during retraction of the derrick mast (21) an inner tube (5) serves as a pump return flow means and a space (10) between an inner tube and a wall of the plunger cylinder as a pump advance flow means.

8. The crane vehicle according to claim 1, characterized in that the hydraulic fluid is a hydraulic oil.

9. A crane vehicle comprising:

a telescopic main boom (20) which is hydraulically extensible;

a telescopic plunger cylinder arranged in the telescopic main boom for hydraulically telescoping the telescopic main boom;

a derrick mast secured to said telescopic main boom;

wherein the derrick mast (21) can be telescoped hydraulically; and wherein the telescopic plunger cylinder (6) of the telescopic main boom (20) is configured as a supply/discharge line for hydraulic fluid, said hydraulic fluid being adapted to be supplied to a derrick cylinder (22) for hydraulically adjusting an inclination of the derrick mast.

10. The crane vehicle according to claim 9, characterized in that the derrick mast (21) is detachably secured to the telescopic main boom (20).

11. The crane vehicle according to claim 9, characterized in that a telescopic inner tube (5) is arranged within the plunger cylinder (6).

12. The crane vehicle according to claim 9, characterized in that lines (3, 4) are provided at an upper end of the plunger cylinder (6) for hydraulically connecting the plunger cylinder (6) via a multi-way valve (12) to the derrick cylinder (22).

13. The crane vehicle according to claim 9, characterized in that lines (3, 4) are provided at an upper end of the plunger cylinder (6) for hydraulically connecting the plunger cylinder (6) via a valve (12) to the derrick mast (21).

14. The crane vehicle according to claim 13, characterized in that during extension and during operation of the derrick mast (21) an inner tube (5) serves as a pump return flow means and a space (10) between an inner tube (5) and a wall of the plunger cylinder (5) serves as a pump advance flow means.

15. The crane vehicle according to claim 13, characterized in that during retraction of the derrick mast (21) an inner tube (5) serves as a pump return flow means and a space (10) between an inner tube and a wall of the plunger cylinder as a pump advance flow means.

16. The crane vehicle according to claim 9, characterized in that the hydraulic fluid is a hydraulic oil.

* * * * *